US006648607B2

(12) United States Patent
Milliff et al.

(10) Patent No.: US 6,648,607 B2
(45) Date of Patent: Nov. 18, 2003

(54) SCROLL COMPRESSOR WITH OIL RESERVOIR ASSOCIATED WITH MOTOR PROTECTOR

(75) Inventors: Tracy L. Milliff, Bristol, VA (US); Jason Hugenroth, Lafayette, IN (US); Chong Yeow Oo, Hot Springs, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/238,459

(22) Filed: Sep. 10, 2002

(65) Prior Publication Data

US 2003/0012663 A1 Jan. 16, 2003

Related U.S. Application Data

(63) Continuation-in-part of application No. 09/690,275, filed on Oct. 17, 2000, now Pat. No. 6,485,268.

(51) Int. Cl.[7] ..... F04B 39/06

(52) U.S. Cl. ..... 417/228; 417/13

(58) Field of Search ..... 417/228, 295, 417/13, 18; 184/6.1, 6.4

(56) References Cited

U.S. PATENT DOCUMENTS

| | | | | | |
|---|---|---|---|---|---|
| 4,361,417 | A | * | 11/1982 | Suzuki | 417/13 |
| 5,118,260 | A | * | 6/1992 | Fraser, Jr. | 418/18 |
| 6,280,146 | B1 | * | 8/2001 | Bush et al. | 417/13 |

* cited by examiner

*Primary Examiner*—Quang T. Van
(74) *Attorney, Agent, or Firm*—Carlson, Gaskey & Olds

(57) ABSTRACT

A scroll compressor has lubricant flow which communicates lubricant onto a motor protector causing the motor protector to trip the motor and stop further rotation when a predetermined lubricant temperature is reached. The motor protector is surrounded by a reservoir which maintains contact between the motor protector and the lubricant, thus facilitating heat transfer between the motor protector and the lubricant. The lubricant is returned to an oil sump remote from the compressor pump set when the reservoir is filled.

9 Claims, 2 Drawing Sheets

SCROLL COMPRESSOR WITH OIL RESERVOIR ASSOCIATED WITH MOTOR PROTECTOR

RELATED APPLICATIONS

This application is a continuation in part of U.S. patent application Ser. No. 09/690,275; filed Oct. 17, 2000, now U.S. Pat. No. 6,485,268.

BACKGROUND OF THE INVENTION

This invention relates to a system in which lubricant flows over portions of a scroll compressor which become hot during reverse rotation or loss of charge, heated lubricant passes onto a motor protector, and the motor protector optimizes detection of certain conditions of the heated oil.

Scroll compressors are becoming widely utilized in refrigerant compression applications. In a scroll compressor, a first scroll member has a base and a generally spiral wrap extending from the base. The wrap of the first scroll member interfits with the wrap from a second scroll member. The second scroll member is caused to orbit relative to the first, and refrigerant is entrapped between the scroll wraps. As the second scroll members orbits, the size of the compression chambers which entrap the refrigerant are reduced, and the refrigerant is compressed.

There are certain design challenges with a scroll compressor. As an example, while the scroll compressor efficiently compresses refrigerant when rotated in a proper forward direction, there are undesirable side effects if the scroll compressor is driven to rotate in a reverse direction. Moreover, if the level of refrigerant or charge level being passed through the compressor is lower than expected, there may also be undesirable side effects. Among the many undesirable side effects is an increased heat level at the scroll compressor members.

One safety feature incorporated into most sealed compressors is the use of a motor protector associated with the electric motor for driving the compressor. The same is true in a scroll compressor, wherein a motor protector is typically associated with the stator for the electric motor. The motor protector operates to stop rotation of the motor in the event there is an electrical anomaly, or if the motor protector senses an unusually high temperature. However, the problems mentioned above with regard to reverse rotation and loss of charge typically cause heat to increase at the compressor pump set, which is relatively far from the motor. Thus, it may take an undue length of time for the additional heat being generated in the compressor pump set to pass to the motor protector.

SUMMARY OF THE INVENTION

In the disclosed embodiment of this invention, lubricant is caused to flow over a portion of a compressor which becomes hot when adverse conditions are present in the compressor pump set. In the disclosed embodiment of this invention, lubricant is caused to flow over a motor protector of a compressor pump set in sufficient quantities to cause the motor protector to trip the motor and stop further rotation when adverse conditions are present in the compressor pump set. A motor protector is enclosed in a reservoir which allows the heated oil to collect around the motor protector, thereby allowing better heat transfer to the motor protector than if a reservoir were not used. As such, the motor protector will sense an increased temperature much sooner, tripping the motor to stop further rotation of the scroll members.

These and other features can be best understood from the following specification and drawings, the following which is a brief description.

DETAILED DESCRIPTION OF PREFERRED EMBODIMENTS

Figure 1:
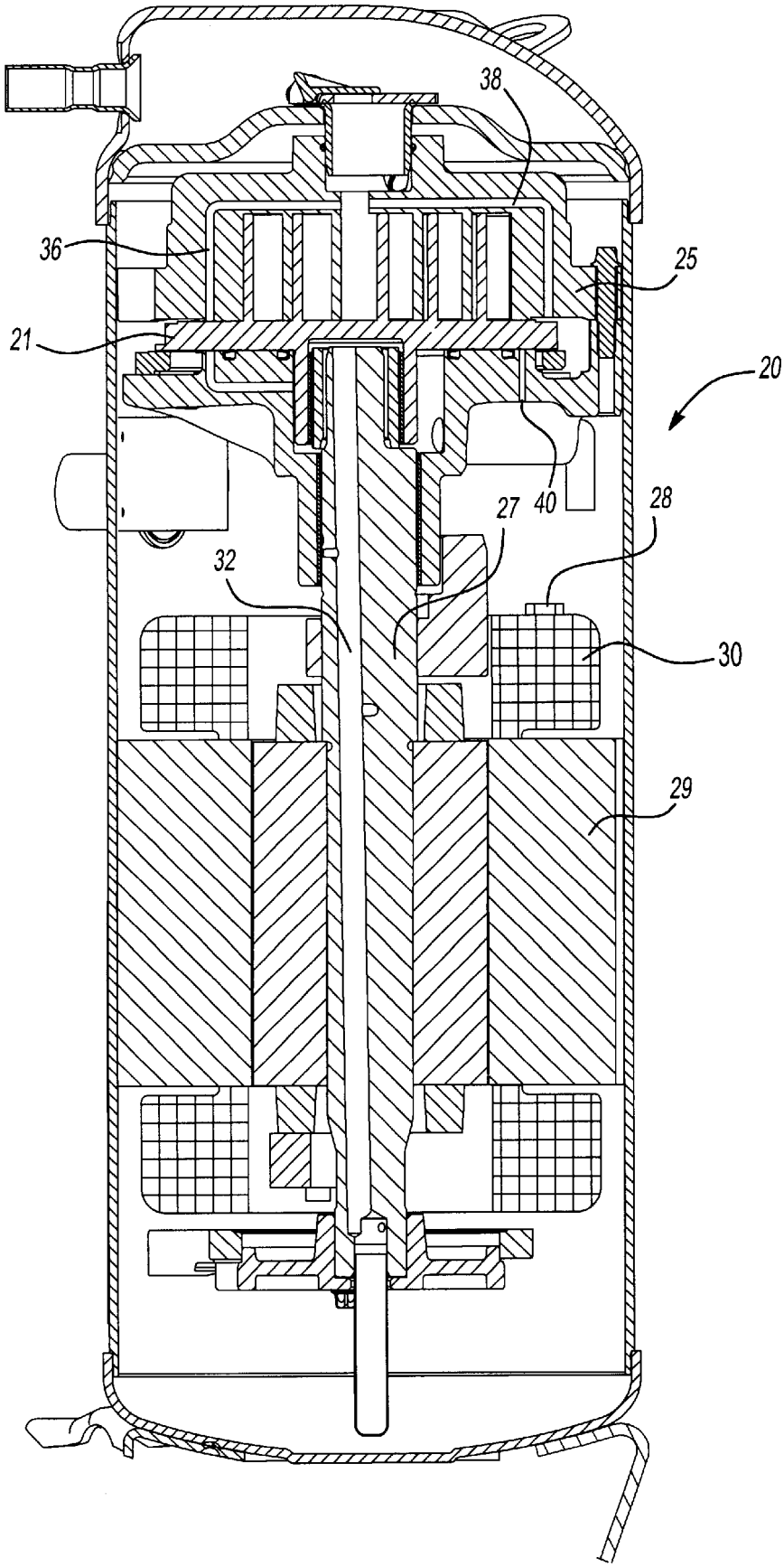
FIG. 1 is a cross-sectional view through a compressor pump set as generally set forth in the parent application.

FIG. 1 shows a cross-section of a scroll compressor 20 having a compressor pump set which incorporates an orbiting scroll 121 and a non-orbiting scroll 25. This is a schematic view on one embodiment from the parent application. A motor protector 28 is associated with a motor stator 29. A lubricant level (not shown) is positioned beneath the motor. An oil feed tube 32 extends through drive shaft 27. Downstream fluid flow portions 36 and 38, shown schematically, pass over the non-orbiting scroll 25. An outlet 40 returns the heated lubricant to the lubricant sump. While FIG. 1 depicts the oil feed obtained directly from the sump, the oil feed may also be obtained from elsewhere as known in the art.

Figure 2:
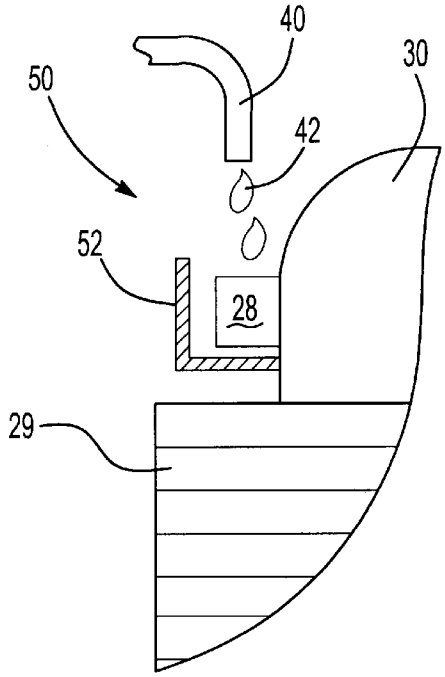
FIG. 2 is a cross-sectional view of a first embodiment reservoir of the present invention.

FIG. 2 shows a first embodiment 50 of the present invention wherein a reservoir 52 surrounds the oil protector 28 and collects the heated oil 42 as it exits from the outlet 40. If the heated oil 42 reaches an unusually high temperature, the motor protector 28 senses this abnormal condition and stops further rotation of the motor. However, under normal operating conditions, the heated oil 42 will not be sufficiently heated to trip the motor protector 28. In this case, the heated oil 42 will fill the cup 42 and overflow into the sump.

Figure 3:
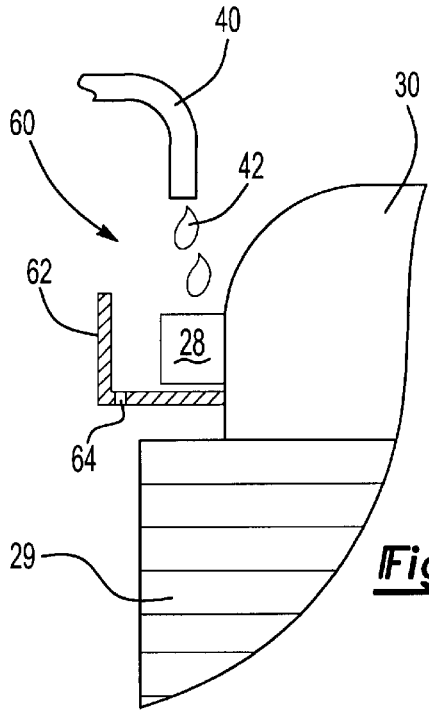
FIG. 3 is a cross-sectional view of a second embodiment reservoir of the present invention.

FIG. 3 shows a second embodiment 60 which differs only slightly from first embodiment 50. In this embodiment 60, a reservoir 62 having an opening 64 surrounds the motor protector 28 and collects the heated oil 42 as it exits from the outlet 40. Similar to the first embodiment, when the heated oil 42 reaches an unusually high temperature, the motor protector 28 senses this abnormal condition and stops further rotation of the motor. Under normal operation, the heated oil 42 will not trip the motor protector 28 and will instead return to the sump through the opening 64 with high lubricant flow, the lubricant may also pass over the ledge of the reservoir 62.

Figure 4:
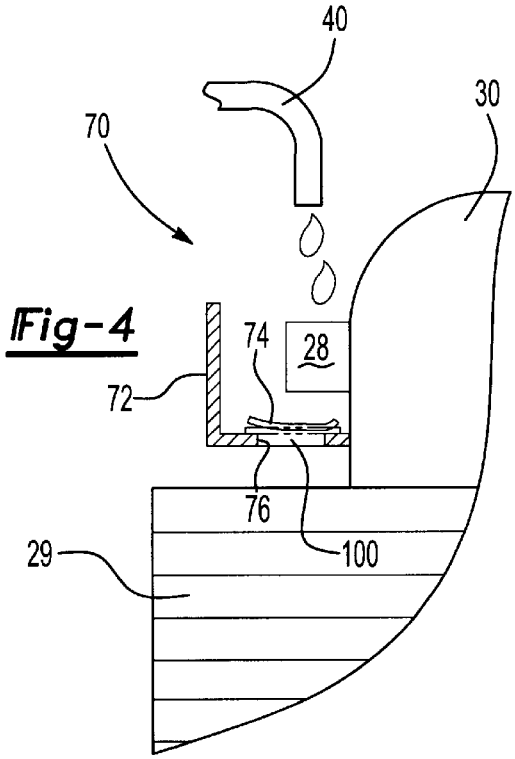
FIG. 4 is a cross-sectional view of a third embodiment reservoir of the present invention.

FIG. 4 shows a third embodiment 70 wherein a reservoir 72 surrounds the motor protector 28 and collects the heated oil 42. A bimetal clip 74 controls a drain 76 in the reservoir 72. Under normal operating conditions, oil 42 flows over the protector 28 and then drains out of the reservoir 72 through the drain 76. When the oil 42 becomes sufficiently heated, the bimetal clip 74 snaps and closes the drain 76 as shown in dotted line at 100, allowing the heated lubricant 42 to collect around and trip the protector 28, thereby stopping further rotation of the motor.

Figure 5:
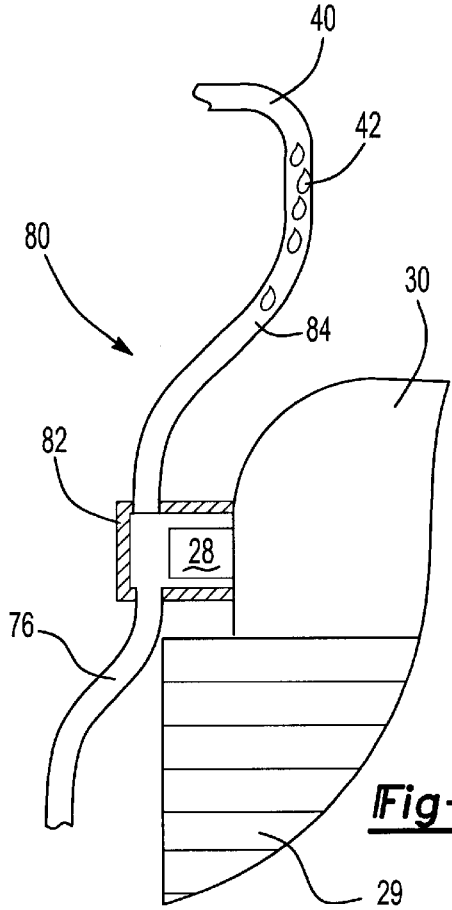
FIG. 5 is a cross-sectional view of a fourth embodiment reservoir of the present invention.

FIG. 5 shows a fourth embodiment 80 wherein a reservoir 82 surrounds the motor protector 28 and collects the heated oil as in previous embodiments. Embodiment 80 differs in that a diversion tube 84 diverts the heated oil 42 from the outlet 40 to the reservoir 82, thereby allowing the outlet 40 to be positioned remote from the motor protector 28 as necessary to avoid redesign of housing or compressor pump unit detail; the diversion tube 84 can be utilized to take the heated oil 42 and move it circumferentially so that it is in the proper position relative to the protector 28. An outlet 86 in the reservoir 82 returns the oil 42 to the sump. FIG. 5 shows the system comprised of the diversion tube 84, the reservoir 82 and the outlet 86 as a closed system. However, it is conceivable that the diversion tube 84 could end before the reservoir 82 begins, thus creating an open system with the same components.

It should be understood that while the invention has been disclosed for reacting to a predetermined high temperature or loss or gain of pressure within the compressor pump set 22, other conditions could cause the actuation. Although preferred embodiments of this invention have been disclosed, a worker in this art would recognize that certain modifications would come within the scope of this invention. For instance, heated oil may only selectively pass to the motor protector 28 at which time the reservoir 52, 62, 72, 82 would be utilized. Further, while the preferred location for attachment of the reservoir 52, 62, 72, 82 is to the stator 29, the reservoir 52, 62, 72, 82 may be attached to the stator windings 30, the stator laminations, the crankcase or the centershell. For these reasons, the following claims should be studied to determine the true scope and content of this invention.

What is claimed is:

1. A scroll compressor comprising:

a compressor pump unit having a first scroll member having a base and a generally spiral wrap extending from said base, a second scroll member having a base and a generally spiral wrap extending from said base, said spiral wraps of said first and second scroll members interfitting to define compression chambers, and a crankcase for supporting said second scroll member;

a shaft for driving said second scroll member to orbit relative to said first scroll member, and compression chambers between said wraps of said first and second scroll member decreasing in size as said second scroll member orbits to compress an entrapped refrigerant;

a motor for driving a shaft to cause said second scroll member to orbit, said motor having a rotor and a stator, and a motor protector associated with said motor stator, said motor protector being operable to stop further operation of said motor;

an oil return passage for passing lubricant over a heating portion of said compressor pump unit, said oil return passage being positioned to return lubricant from said heating portion of said compressor pump unit to an outlet for passing lubricant into a reservoir surrounding said motor protector, said reservoir maintaining contact between lubricant and said motor protector;

said motor stator having a first end spaced toward said compressor pump unit and a second end spaced on an opposed side of said first end relative to said compressor pump unit, said motor protector being at said first end of said motor stator with said reservoir also being at said first end of said motor stator.

2. A scroll compressor comprising:

a compressor pump unit having a first scroll member having a base and a generally spiral wrap extending from said base, a second scroll member having a base and a generally spiral wrap extending from said base, said spiral wraps of said first and second scroll members interfitting to define compression chambers, and a crankcase for supporting said second scroll member;

a shaft for driving said second scroll member to orbit relative to said first scroll member, and compression chambers between said wraps of said first and second scroll member decreasing in size as said second scroll member orbits to compress an entrapped refrigerant;

a motor for driving a shaft to cause said second scroll member to orbit, said motor having a rotor and a stator, and a motor protector associated with said motor stator, said motor protector being operable to stop further operation of said motor;

an oil return passage for passing lubricant over a heating portion of said compressor pump unit, said oil return passage being positioned to return lubricant from said heating portion of said compressor pump unit to an outlet for passing lubricant into a reservoir surrounding said motor protector, said reservoir maintaining contact between lubricant and said motor protector; and said reservoir comprises a closed bottom vessel such that excess lubricant overflows the top of said reservoir and returns to a sump.

3. A scroll compressor comprising:

a compressor pump unit having a first scroll member having a base and a generally spiral wrap extending from said base, a second scroll member having a base and a generally spiral wrap extending from said base, said spiral wraps of said first and second scroll members interfitting to define compression chambers, and a crankcase for supporting said second scroll member;

a shaft for driving said second scroll member to orbit relative to said first scroll member, and compression chambers between said wraps of said first and second scroll member decreasing in size as said second scroll member orbits to compress an entrapped refrigerant;

a motor for driving a shaft to cause said second scroll member to orbit, said motor having a rotor and a stator, and a motor protector associated with said motor stator, said motor protector being operable to stop further operation of said motor;

an oil return passage for passing lubricant over a heating portion of said compressor pump unit, said oil return passage being positioned to return lubricant from said heating portion of said compressor pump unit to an outlet for passing lubricant into a reservoir surrounding said motor protector, said reservoir maintaining contact between lubricant and said motor protector; and said reservoir includes an opening such that excess lubricant exits said reservoir through said opening and returns to a sump.

4. A scroll compressor as recited in claim 3, wherein said opening includes a temperature sensitive member such that when lubricant reaches said predetermined temperature, said member blocks said opening and said reservoir fills with heated lubricant, thereby tripping said motor protector and stopping further rotation of said motor.

5. A scroll compressor as recited in claim 4, wherein said temperature sensitive member is a bimetal clip.

6. A scroll compressor as recited in claim 1, wherein a diversion tube directs lubricant from said outlet to said reservoir.

7. A scroll compressor as recited in claim 6, wherein said oil return passage is remote from said motor protector and said reservoir.

8. A scroll compressor comprising:

a compressor pump unit having a first scroll member having a base and a generally spiral wrap extending from said base, a second scroll member having a base and a generally spiral wrap extending from said base, said spiral wraps of said first and second scroll members interfitting to define compression chambers, and a crankcase for supporting said second scroll member;

a shaft for driving said second scroll member to orbit relative to said first scroll member, and compression chambers between said wraps of said first and second scroll member decreasing in size as said second scroll member orbits to compress an entrapped refrigerant;

a motor for driving a shaft to cause said second scroll member to orbit, said motor having a rotor and a stator, and a motor protector associated with said motor stator, said motor protector being operable to stop further operation of said motor;

an oil return passage for passing lubricant over a heating portion of said compressor pump unit, said oil return passage being positioned to return lubricant from said heating portion of said compressor pump unit to an outlet for passing lubricant into a reservoir surrounding said motor protector, said reservoir maintaining contact between lubricant and said motor protector; and said reservoir includes an oil return tube for returning lubricant to a sump.

9. A scroll compressor comprising:

a compressor pump unit having a first scroll member having a base and a generally spiral wrap extending from said base, a second scroll member having a base and a generally spiral wrap extending from said base, said spiral wraps of said first and second scroll members interfitting to define compression chambers, and a crankcase for supporting said second scroll member;

a shaft for driving said second scroll member to orbit relative to said first scroll member, and compression chambers between said wraps of said first and second scroll member decreasing in size as said second scroll member orbits to compress an entrapped refrigerant;

a motor for driving a shaft to cause said second scroll member to orbit, said motor having a rotor and a stator, and a motor protector associated with said motor stator, said motor protector being operable to stop further operation of said motor; and an oil return passage for passing lubricant over a heating portion of said compressor pump unit, said oil return passage being positioned to return lubricant from said heating portion of said compressor pump unit to an outlet for passing lubricant into a reservoir surrounding said motor protector, said reservoir maintaining contact between lubricant and said motor protector, said compressor pump unit being received within a sealed housing, with a sump at an end of said motor spaced from said compressor pump unit, said oil moving from said reservoir into said sump, and said reservoir and said motor protector being spaced in a direction toward said compressor pump unit, and outwardly of said sump.

* * * * *